US007849583B2

(12) United States Patent
Horimoto et al.

(10) Patent No.: US 7,849,583 B2
(45) Date of Patent: Dec. 14, 2010

(54) MICROPHONE MANUFACTURING METHOD

(75) Inventors: Yasuhiro Horimoto, Kyoto (JP); Takashi Kasai, Kyoto (JP)

(73) Assignee: OMRON Corporation, Kyoto-shi (JP)

( * ) Notice: Subject to any disclaimer, the term of this patent is extended or adjusted under 35 U.S.C. 154(b) by 117 days.

(21) Appl. No.: 12/296,646

(22) PCT Filed: Feb. 23, 2007

(86) PCT No.: PCT/JP2007/053401

§ 371 (c)(1),
(2), (4) Date: Oct. 9, 2008

(87) PCT Pub. No.: WO2007/125675

PCT Pub. Date: Nov. 8, 2007

(65) Prior Publication Data

US 2009/0181489 A1 Jul. 16, 2009

(30) Foreign Application Priority Data

Apr. 27, 2006 (JP) ..... 2006-123652

(51) Int. Cl.
*H04R 31/00* (2006.01)

(52) U.S. Cl. ..... 29/594; 29/592.1; 29/609.1; 216/52; 381/358

(58) Field of Classification Search ..... 29/592.1, 29/594, 595, 417, 609.1; 381/173–174, 181, 381/191, 358, 360, 368; 367/170–171, 181; 216/62, 66; 181/171–172
See application file for complete search history.

(56) References Cited

U.S. PATENT DOCUMENTS 5,452,268 A * 9/1995 Bernstein ..... 367/181
7,080,442 B2 * 7/2006 Kawamura et al. ..... 29/594
7,204,009 B2 * 4/2007 Kawamura et al. ..... 29/594
7,434,305 B2 * 10/2008 Minervini ..... 29/594

FOREIGN PATENT DOCUMENTS

JP 62-76784 4/1987

OTHER PUBLICATIONS

Patent Abstracts of Japan JP62076784 dated Apr. 8, 1987 (1 page).
Patent Abstracts of Japan JP2004-506394 dated Feb. 26, 2004 (English version 11 pages, Japanese version 10 pages) (21 pages total).

* cited by examiner

*Primary Examiner*—Minh Trinh
(74) *Attorney, Agent, or Firm*—Osha Liang LLP

(57) ABSTRACT

A microphone manufacturing method that includes forming an etching protective film on a surface of a semiconductor substrate, opening an etching window through the etching protective film, and forming a sacrifice layer in the etching window and also on an upper face of the etching protective film. The method includes forming a vibration film above said sacrifice layer and starting an etching process of said sacrifice layer through a preformed port at a location wherein said sacrifice layer is sandwiched by said vibration film and the etching protective film and located apart from the etching window. The etching process uses an etchant to which the etching protective film is resistant, to open the etching window. The method includes crystal anisotropically etching said semiconductor substrate through the port and the etching window by using an etchant to which the etching protective film is resistant so that a cavity is formed.

9 Claims, 17 Drawing Sheets

(a)

(b)

MICROPHONE MANUFACTURING METHOD

TECHNICAL FIELD

This invention relates to a microphone manufacturing method, and specifically a small-size microphone manufacturing method, in which a vibration film is formed on a semiconductor substrate.

BACKGROUND ART

In a microphone, when a static pressure difference occurs between upper and lower spaces of a vibration film, the vibration film is warped due to the static pressure difference, and the sensitivity of the microphone is thus lowered. For this reason, a bent hole that aims to balance the static pressures is sometimes formed between the semiconductor substrate and the vibration film.

However, when even a sound pressure is balanced by the bent hole, the vibration film fails to vibrate by the sound pressure. Therefore, the bent hole is desirably formed as a passage having a high acoustic resistance. The acoustic resistance becomes higher as the cross-sectional area of the passage becomes smaller and the length thereof becomes longer. For this reason, in order to form a bent hole having a high acoustic resistance, the bent hole having a small cross-sectional area and a long passage needs to be formed.

Examples of the microphone formed on a semiconductor substrate include one disclosed in Published Japanese Translation of a PCT Application No. 2004-506394 (Patent Document 1). In this microphone, a bent hole is formed between the semiconductor substrate and the vibration film. In this microphone, however, a cavity is formed below a vibration film by crystal anisotropically etching the semiconductor substrate from the back face side.

Consequently, in this microphone, a slanting face derived from a monocrystalline silicon (111) crystal plane or a crystal plane equivalent thereto appears on the periphery of the cavity, thereby resulting that the opening area of the cavity becomes larger on the back face side of the semiconductor substrate, and the opening area of the cavity is made smaller on the surface side. In this state, the opening area of the cavity on the back face side becomes larger in comparison with the size of the vibration film, thereby making it difficult to manufacture a small-size microphone. Therefore, in the microphone disclosed in Patent Document 1, even when a bent hole having a great acoustic resistance is achieved, it is difficult to manufacture a small-size microphone.

Examples of a method for forming a cavity by carrying out etching on a semiconductor substrate from the surface side include a method for manufacturing a pressure sensor, disclosed in Japanese Unexamined Patent Application Publication (JP-A) No. 62-76784 (Patent Document 2). As shown in FIGS. 1(*a*) to 1(*d*), this method includes processes in which a sacrifice layer 13 is preliminarily formed between a semiconductor substrate 11 and a diaphragm 12, and the sacrifice layer 13 is isotropically etched from a chemical (etchant) charging port (etching hole) 14 formed to be opened on the diaphragm 12 so that an etching window 15 is formed between the surface of the semiconductor substrate 11 and the diaphragm 12. Thus, the semiconductor substrate 11 is crystal anisotropically etched from this etching window 15 so that a cavity 16 is formed.

However, since, upon microphone manufacturing by using this method, the chemical charging port of the vibration film (diaphragm) is directly connected to the etching window, the acoustic resistance becomes extremely small when this chemical charging port is utilized as a bent hole, and the sensitivity of the vibration film might be thus lowered. Moreover, since the chemical charging port is formed in the center of the vibration film, the strength of the vibration film tends to be lowered, and adverse effects tend to be given to the acoustic characteristic.

Patent Document 1: Published Japanese translation of a PCT application No. 2004-506394

Patent Document 2: JP-A No. 62-76784

DISCLOSURE OF THE INVENTION

Problems to be Solved by the Invention

In view of the above state of the art, the present invention has been devised, and its object is to provide a microphone manufacturing method that can form a cavity in a semiconductor substrate by carrying out an etching process thereon from the surface side, and can also easily form a bent hole having a great acoustic resistance.

Means to Solve the Problems

The microphone manufacturing method in accordance with the present invention is characterized by including the steps of: forming an etching protective film on a surface of a semiconductor substrate, and then opening an etching window through the etching protective film; forming a sacrifice layer in the etching window as well as on an upper face of the etching protective film, with at least one portion thereof being connected to each other; forming a vibration film above the sacrifice layer; starting an etching process on the sacrifice layer from a portion that is sandwiched by the vibration film and the etching protective film and located apart from the etching window, by using an etchant to which the etching protective film is resistant, so that the etching window is opened; and crystal anisotropically etching the semiconductor substrate from the etching window by using the etchant to which the etching protective film is resistant so that a cavity is formed in the semiconductor substrate on the surface side thereof. The etching start portion that is sandwiched by the vibration film and the etching protective film, and located apart from the etching window is not necessarily coincident with a portion at which the etching process of the sacrifice layer is started.

In the microphone manufacturing method of the present invention, a sacrifice layer is preliminarily formed in the etching window below the vibration film as well as on an upper face of the etching protective film, with at least one portion thereof being connected to each other, and by using an etchant to which the etching protective film is resistant, an etching process is started from a portion apart from the etching window so that an etching window is opened, while by using an etchant to which the etching protective film is resistant, the semiconductor substrate is crystal anisotropically etched from the etching window so that a cavity is formed; therefore, a bent hole can be formed between the vibration film and the surface of the semiconductor substrate at a position adjacent to the cavity of the semiconductor substrate. Moreover, since the length of the bent hole passage can be prolonged easily, it is possible to obtain a bent hole having a large acoustic resistance, and consequently to manufacture a microphone having a superior low-frequency characteristic. Furthermore, since the cavity can be formed in the semiconductor substrate by crystal anisotropically etching the semiconductor substrate from the surface side, it is possible to prevent the cavity from expanding greatly on the back face side to give adverse effects to the miniaturization of the microphone.

Certain aspect of the microphone manufacturing method of the present invention is further provided with step in which, prior to forming the vibration film after forming the sacrifice layer, a protective film is formed on the sacrifice layer, by using a material that is resistant to the etchant used for etching the sacrifice layer as well as an etchant used for etching the semiconductor substrate. In accordance with this aspect, since the vibration film can be protected from the etchant by the protective film, the limitation to materials used for forming the vibration film becomes smaller, thereby alleviating the limitations that are imposed upon designing and manufacturing the microphone.

Still another aspect of the microphone manufacturing method of the present invention is characterized in that a protective film is formed on the vibration film by using a material that is resistant to the etchant used for etching the sacrifice layer as well as an etchant used for etching the semiconductor substrate. In accordance with this aspect, since the vibration film can be protected from the etchant by the protective film, the limitation to materials used for forming the vibration film becomes smaller, thereby alleviating the limitations that are imposed upon designing and manufacturing the microphone.

Still another aspect of the microphone manufacturing method of the present invention is characterized in that the sacrifice layer is isotropically etched and the semiconductor substrate is also crystal anisotropically etched by using the same etchant. In accordance with this aspect, since the sacrifice layer and the semiconductor substrate can be continuously etched by using the same etchant, it becomes possible to simplify the microphone manufacturing processes.

Still another aspect of the microphone manufacturing method of the present invention is characterized in that the semiconductor substrate is crystal anisotropically etched by using an etchant that is different from the etchant used for etching the sacrifice layer. In accordance with this aspect, the limitations to the etchant for etching the sacrifice layer as well as the etchant for etching the semiconductor substrate become smaller. Alternatively, the limitation to the material used for constituting the sacrifice layer becomes smaller.

Still another aspect of the microphone manufacturing method of the present invention is characterized in that a back plate having a fixed electrode is formed above the vibration film. This aspect makes it possible to manufacture an electrostatic capacity type of microphone.

Still another aspect of the microphone manufacturing method of the present invention is characterized in that the cavity penetrates the semiconductor substrate from the surface side to back face side. This aspect makes it possible to manufacture a microphone that can pick up acoustic vibrations from the back face side of the semiconductor substrate as well.

Still another aspect of the microphone manufacturing method of the present invention is characterized in that, by preliminarily forming the sacrifice layer on one portion of a formation area of the vibration film, the vibration film is allowed to bend. This aspect makes it possible to increase the positional change of the vibration film, and also to reduce warping due to a stress.

Still another aspect of the microphone manufacturing method of the present invention is characterized in that, by preliminarily forming the sacrifice layer on one portion of a formation area of the vibration film, a protrusion is formed on the surface of the vibration film. When an electrode or the like is disposed above the vibration film, this aspect makes it possible to prevent the deformed vibration film from being made surface-contact with an electrode or the like to be stuck thereto.

The above-mentioned constituent elements of the present invention may be combined with one another, as freely as possible.

REFERENCE NUMERALS

Figure 1:
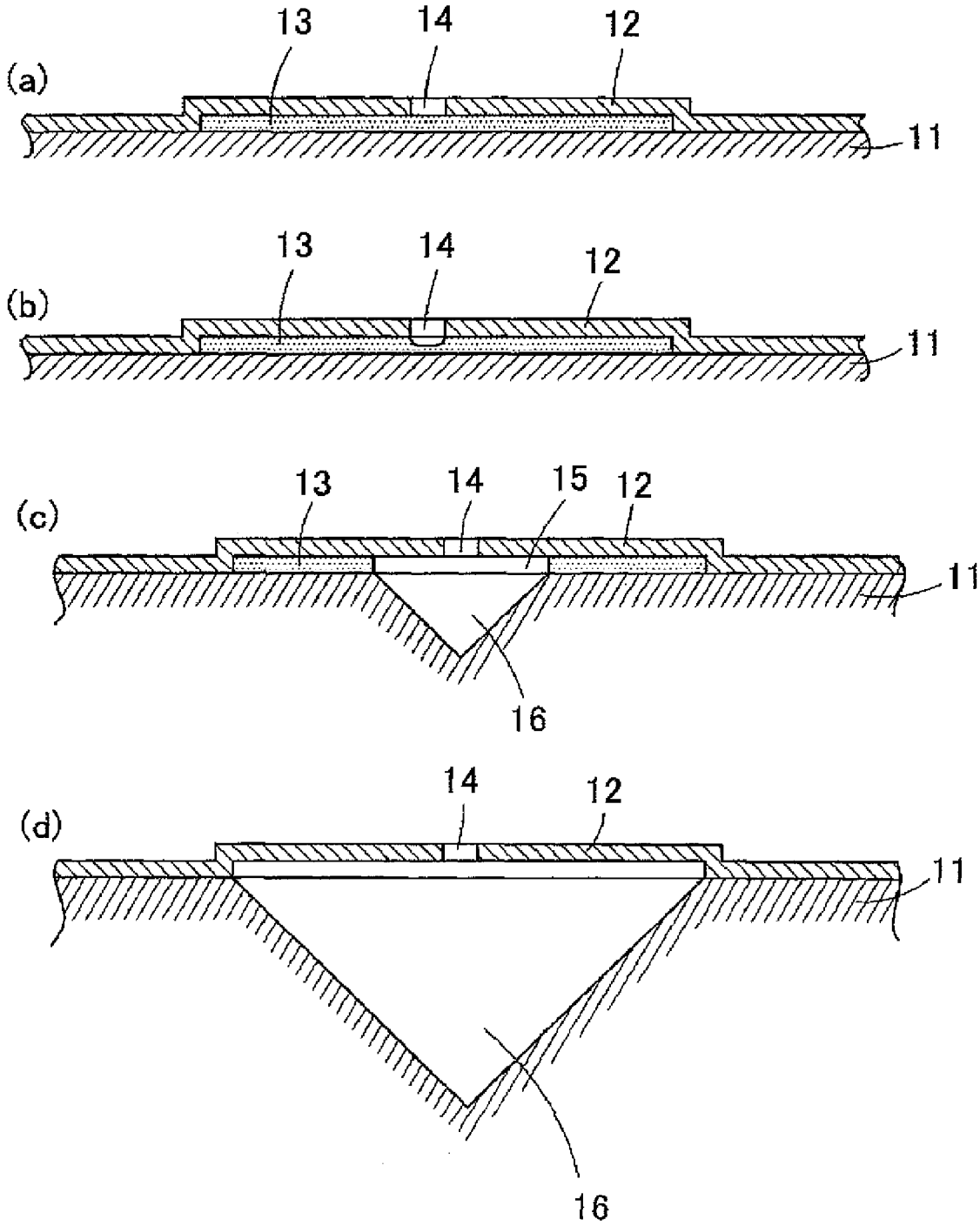
FIGS. 1(*a*) to 1(*d*) are cross-sectional views showing manufacturing processes of a pressure sensor of the prior art.

21 Microphone
22 Si substrate
23 Cavity
24 Vibration film
25 Supporting post

26 Bent hole
27 Back plate
29 Fixed electrode
31 Chemical charging port
32, 33 Protective film
34 Etching window
35 Sacrifice layer
36 Sacrifice layer
37 Protective film
38 Protective film
41 Microphone
42 Vibration film supporting layer
43 Protective film
44 Etching window
45 Protective film
46 Etching hole
51 Microphone
52 Stopper
53 Bending portion

BEST MODE FOR CARRYING OUT THE INVENTION

Referring to Figures, the following description will discuss embodiments of the present invention in detail.

Embodiment 1

Figure 2:
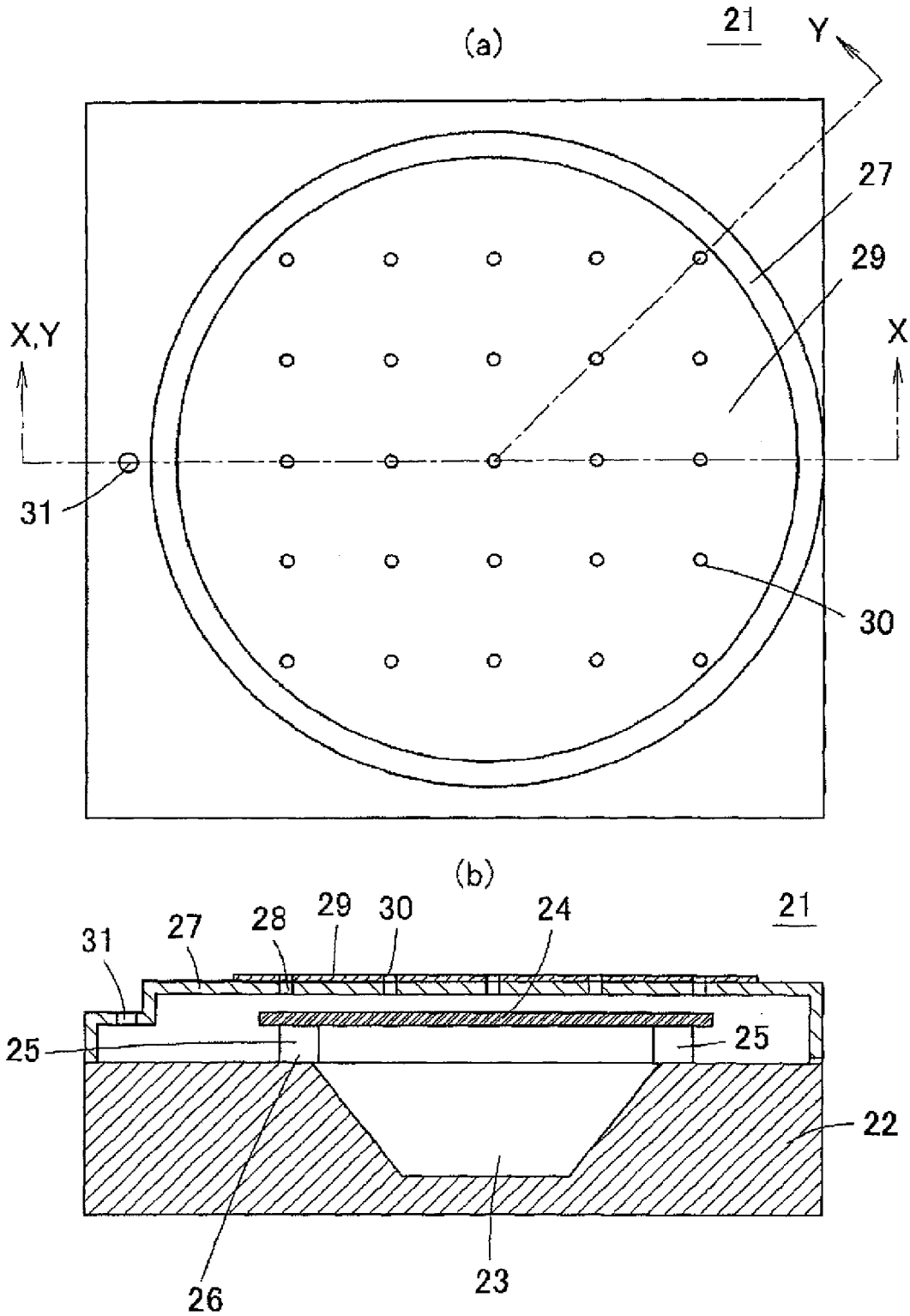
FIG. 2(*a*) is a plan view that shows a structure of a microphone in accordance with embodiment 1 of the present invention, and FIG. 2(*b*) is a X-X line cross-sectional view of FIG. 2(*a*).
Figure 3:
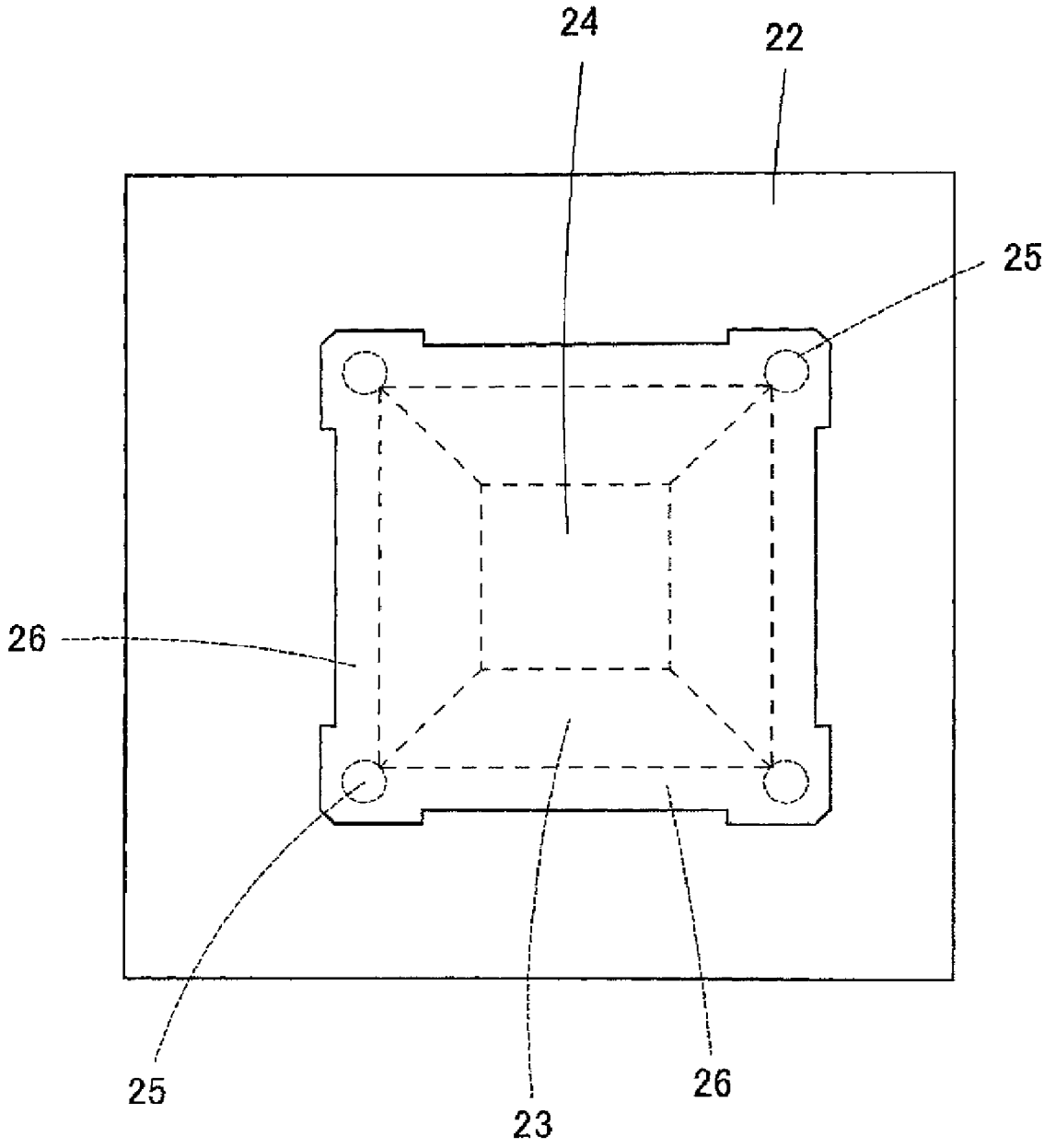
FIG. 3 is a plan view showing a microphone of embodiment 1 from which a back plate has been removed.

FIG. 2(*a*) is a plan view that shows a structure of a microphone 21 in accordance with embodiment 1 of the present invention, and FIG. 2(*b*) is an X-X line cross-sectional view of FIG. 2(*a*). Moreover, FIG. 3 is a plan view that shows a microphone 21 from which a back plate has been removed.

In the microphone 21, a cavity 23 is formed on the surface side of a (100) plane or a (110) plane of the Si substrate 22, and a vibration film 24 is disposed on the Si substrate 22 in such a manner to cover the cavity 23. The cavity 23 is formed by performing crystal anisotropic etching from the surface side of the Si substrate 22, and the peripheral face is formed into a slanting face made of a (111) crystal plane or a crystal plane equivalent thereto, with the opening on the surface side of the cavity 23 being made wider than the bottom face thereof. Four corners of the vibration film 24 are supported by supporting posts 25 formed on the upper surface of the Si substrate 22, with a bent hole 26 having a thin thickness and a long passage length being opened between four sides of the lower face of the vibration film 24 and the upper surface of the Si substrate 22.

On the upper surface of the Si substrate 22, a back plate 27 is disposed so as to cover the upper portion of the vibration film 24, and the lower face of the peripheral portion of the back plate 27 is secured onto the upper surface of the Si substrate 22. A plurality of acoustic holes 28 are pierced through the back plate 27. Moreover, a fixed electrode 29 is formed by a metal material on the upper surface of the back plate 27 so that acoustic holes 30 are pieced into the fixed electrode 29 so as to be made coincident with the acoustic holes 28.

Reference numeral 31 represents a chemical charging port of the back plate 27 used for a manufacturing process of a microphone 21.

In this microphone 21, when acoustic vibrations are propagated through air, water or the like, the acoustic vibrations enter the inside of the microphone 21 through the acoustic holes 30 and 28, and allow the vibration film 24 to vibrate. When the vibration film 24 vibrates, since the electrostatic capacity between the vibration film 24 (movable electrode) and the fixed electrode 29 is changed, by detecting this change in the electrostatic capacity, the acoustic vibrations can be sensed.

Figure 4:
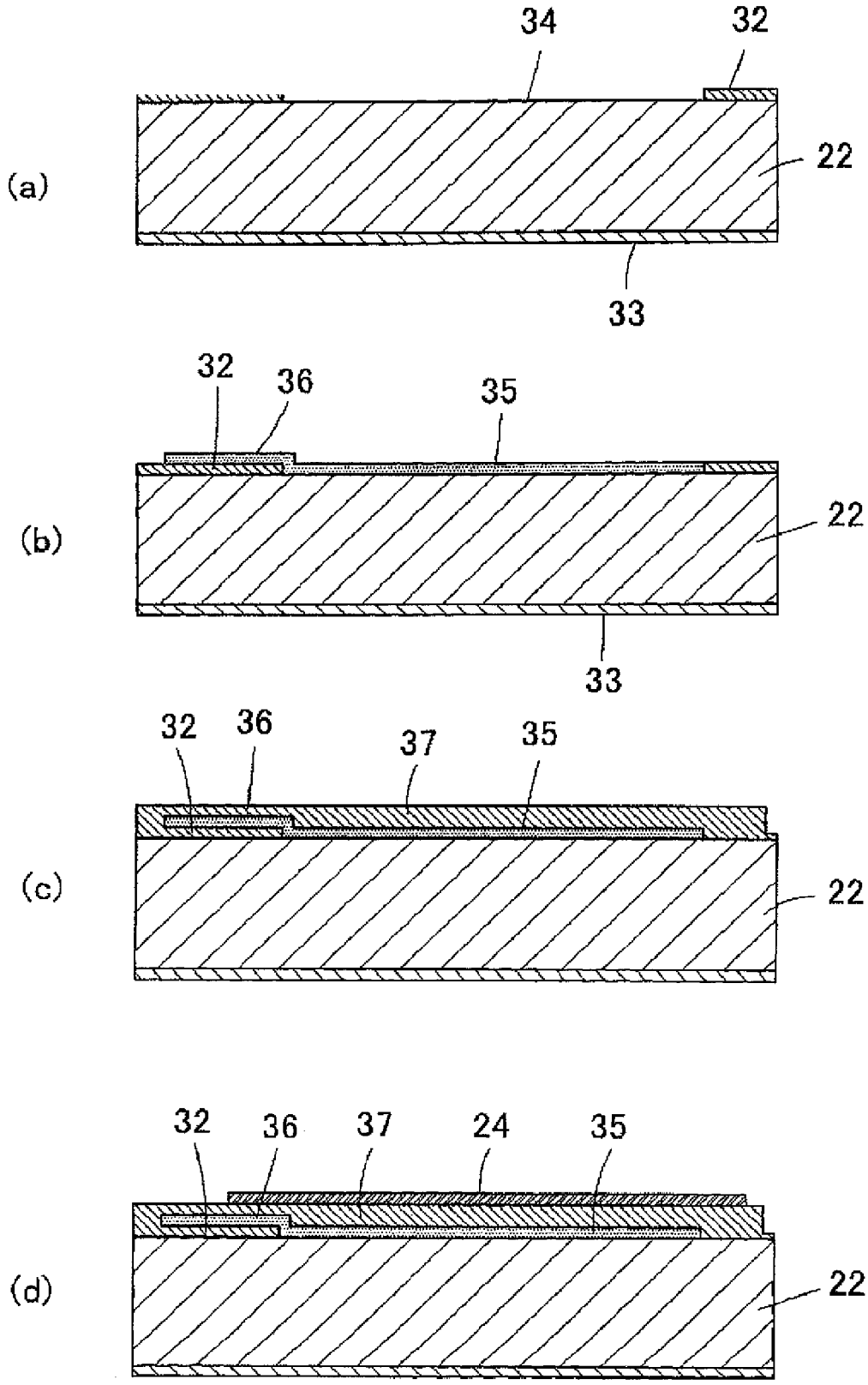
FIGS. 4(*a*) to 4(*d*) are cross-sectional views showing manufacturing processes of the microphone of embodiment 1.
Figure 5:
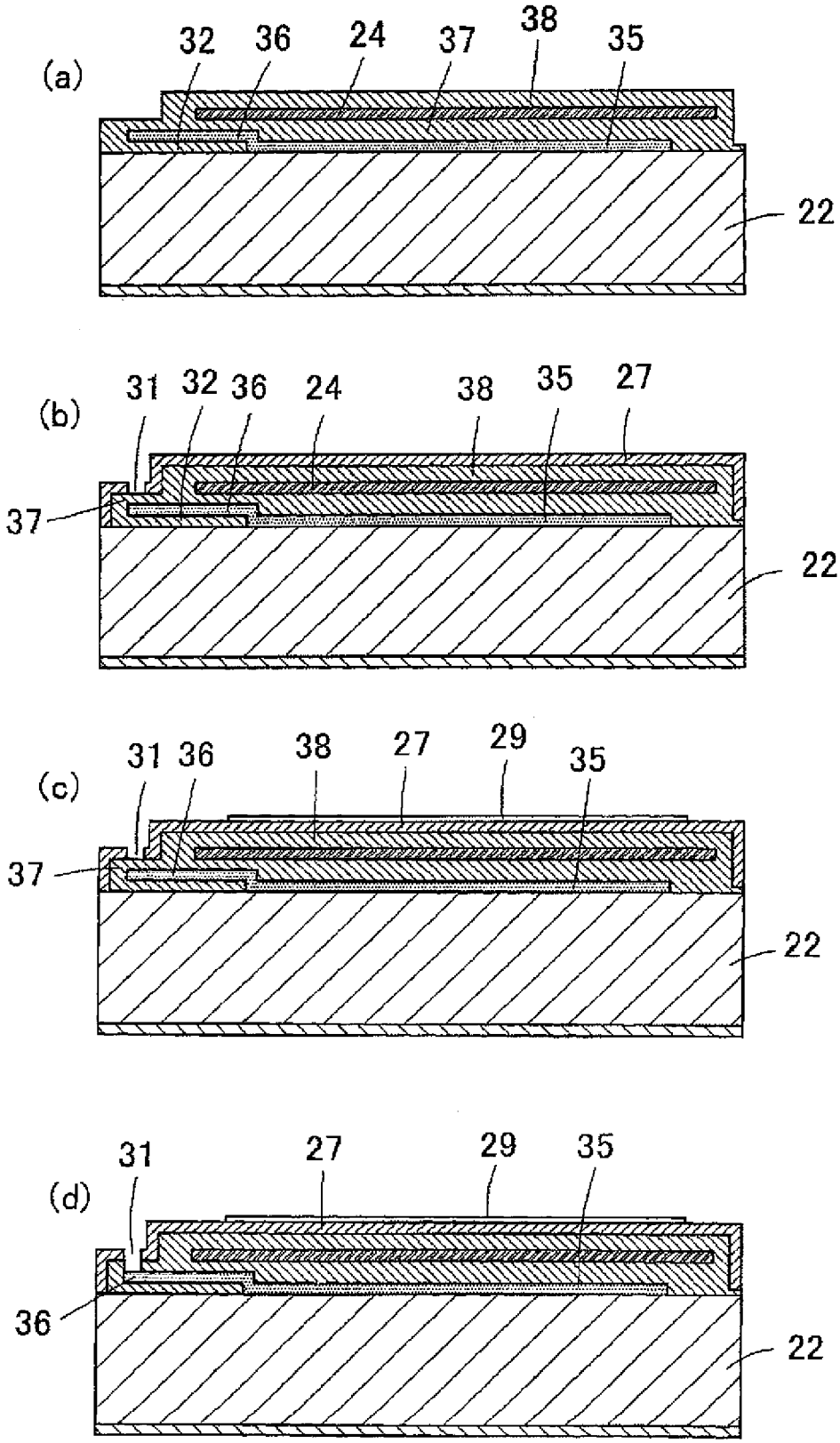
FIGS. 5(*a*) to 5(*d*) are cross-sectional views showing manufacturing processes of the microphone of embodiment 1, which follow FIG. 4(*d*).
Figure 6:
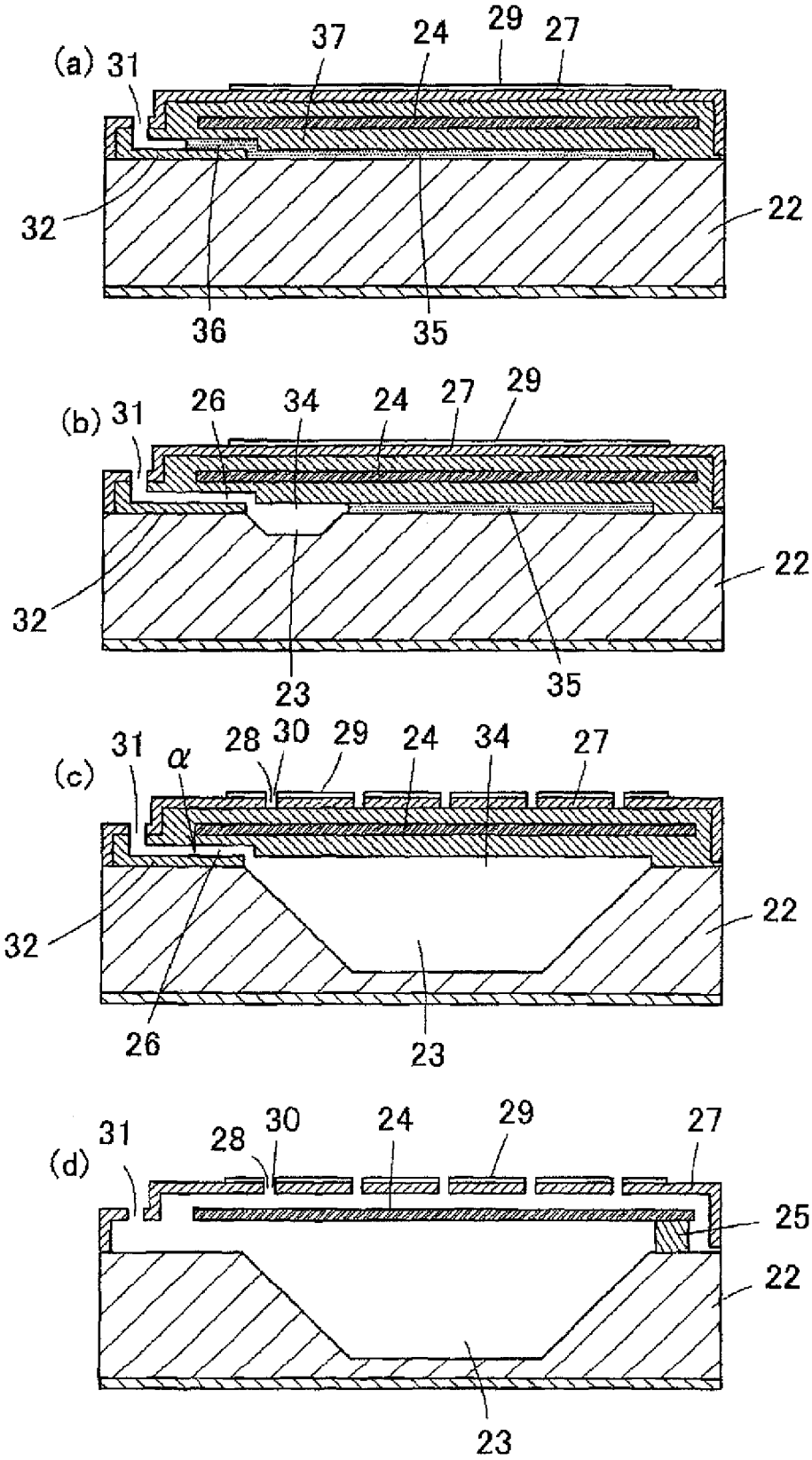
FIGS. 6(*a*) to 6(*d*) are cross-sectional views showing manufacturing processes of the microphone of embodiment 1, which follow FIG. 5(*d*).
Figure 7:
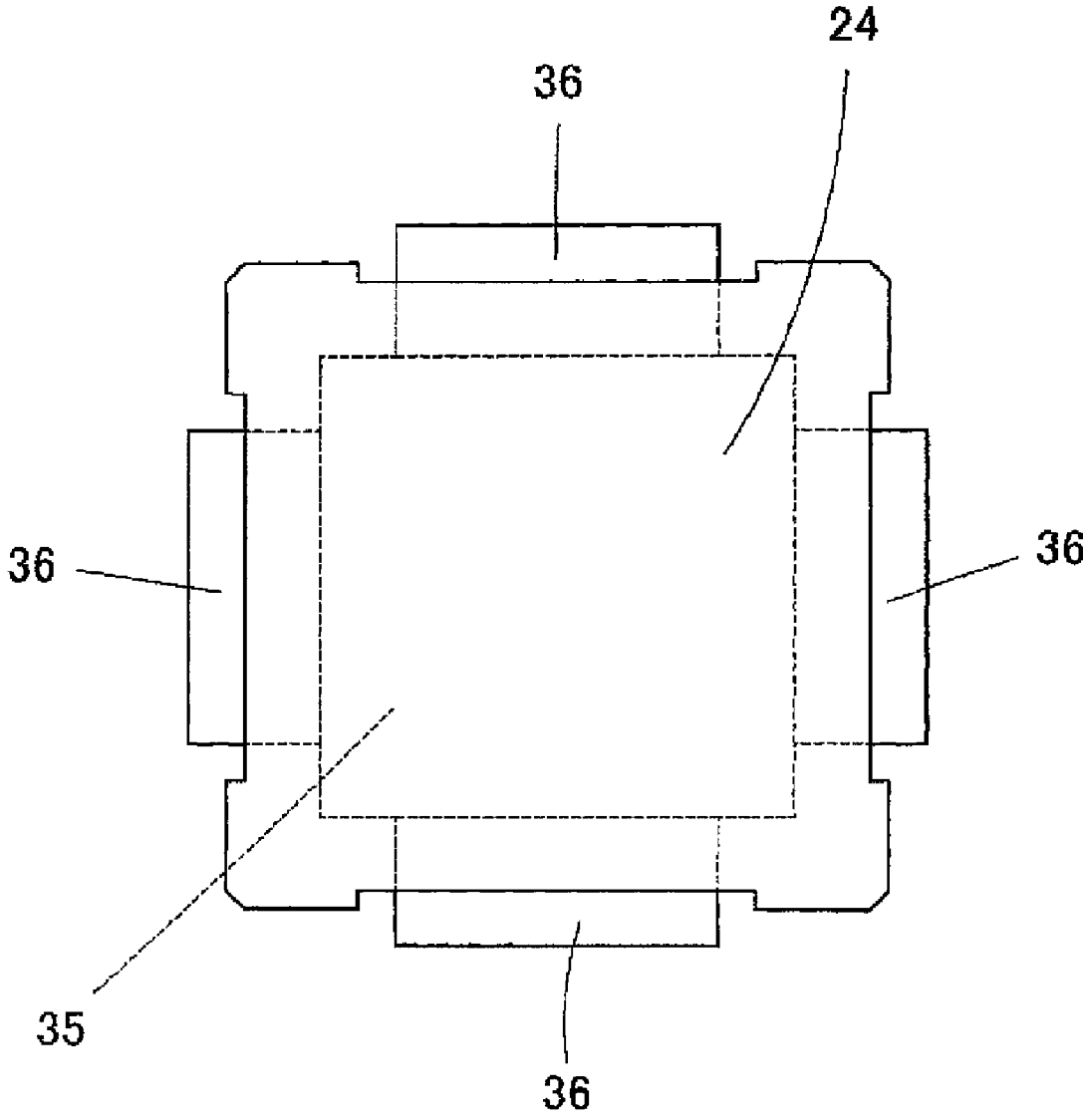
FIG. 7 is a plan view showing a positional relationship between a vibration film and a sacrifice layer.
Figure 8:
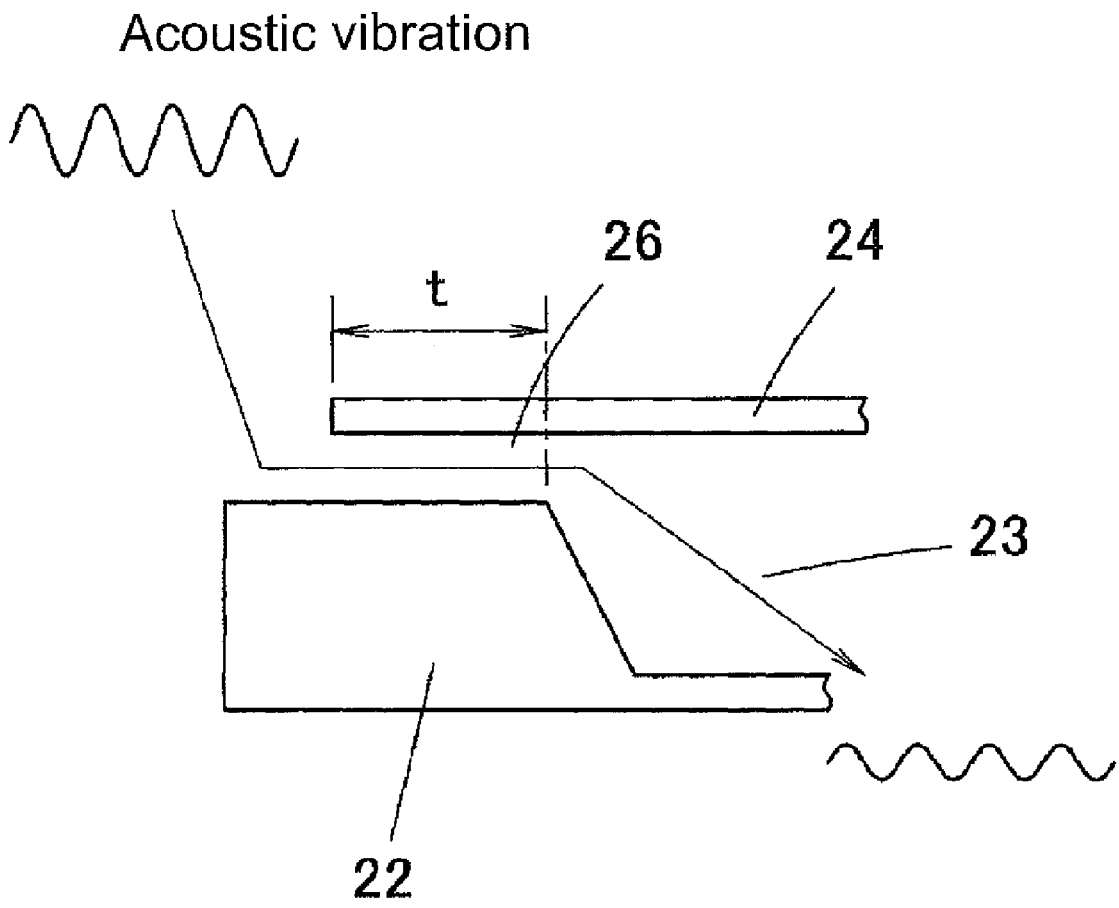
FIG. 8 is a schematic view explaining functions of a bent hole.

Next, referring to FIGS. 4(*a*) to 4(*d*), FIGS. 5(*a*) to 5(*d*), FIGS. 6(*a*) to 6(*d*) and FIG. 7, manufacturing processes of the microphone 21 are explained. Here, FIGS. 4(*a*) to 4(*d*), FIG. 5(*a*) to 5(*d*) and FIGS. 6(*a*) to 6(*d*) indicate cross sections corresponding to a Y-Y line cross section of FIG. 2. Although a large number of microphones 21 are manufactured on a wafer at one time, the following explanation will be given by illustrating only one microphone 21.

First, as shown in FIG. 4(*a*), a protective film 32 (etching protective film) and a protective film 33, made from $SiO_2$, are formed on the surface and the rear surface of a (100) plane or (110) plane of an Si substrate 22 (wafer) by using a thermal oxidizing method or the like. Next, on the surface of the Si substrate 22, the protective film 32 on an area to form a cavity 23 is partially removed by using a photolithography technique so that an etching window 34 is opened in accordance with the upper surface opening of the cavity 23 to be formed.

A polysilicon thin-film is formed on the surface of the Si substrate 22 over the protective film 32, and the polysilicon thin-film is patterned by using a photolithographic technique. Thus, a sacrifice layer 35, made from a polysilicon thin-film, is formed on the surface of the Si substrate 22 inside the etching window 34. Moreover, on the upper surface of the protective film 32, a sacrifice layer 36 is formed in such a manner to connect to the sacrifice layer 35 on an area to form a bent hole 26. FIG. 4(*b*) shows this state.

Next, a protective film 37, made from $SiO_2$, is formed on the surface of the Si substrate 22 over the sacrifice layers 35 and 36 so that, as shown in FIG. 4(*c*), the sacrifice layers 35 and 36 are covered and concealed with the protective film 37. A polysilicon thin film is formed on the protective film 37, and unnecessary portions of the polysilicon thin film are removed by using a photolithographic technique so that, as shown in FIG. 4(*d*), a vibration film 24 made of the polysilicon thin-film is formed on the protective film 37. At this time, when viewed in a direction perpendicular to the vibration film 24, as shown in FIG. 7, the sacrifice layer 35 is withdrawn toward the inside from the periphery of the vibration film 24 so that the sacrifice layer 36 protrudes outward of the vibration film 24 from four sides of the vibration film 24 in such a manner to avoid the corner portions of the vibration film 24.

Next, as shown in FIG. 5(*a*), a protective film 38 made from $SiO_2$ is formed on the vibration film 24 so that the vibration film 24 is covered and concealed with the protective film 38.

After the protective films 32, 37 and 38 on the surface side have been etched in accordance with the inner-face shape of a back plate 27, an SiN film is formed on the surfaces of the protective films 32, 37 and 38, as shown in FIG. 5(*b*), so that the back plate 27 is formed by the SiN film. Moreover, a chemical charging port 31 is opened at a position opposing to the end portion of the sacrifice layer 36 on the edge of the back plate 27 so that the protective film 37 is exposed through the chemical charging port 31.

Moreover, a Cr film is formed on the surface of the back plate 27 as shown in FIG. 5(*c*), and Au is film-formed thereon so that an Au/Cr film is obtained, and the Au/Cr film is then etched into a predetermined shape to produce a fixed electrode 29.

Furthermore, as shown in FIG. 5(*d*), an etchant such as HF aqueous solution is made in contact with the protective film 37 from the etching hole 31, and one portion of the protective film 37 is consequently removed so that the sacrifice layer 36 is exposed below the etching hole 31.

After the sacrifice layer 36 has been exposed, the Si substrate 22 is immersed into an etchant such as TMAH or the like. When the Si substrate 22 is immersed into the etchant such as TMAH, as shown in FIG. 6(*a*), the polysilicon sacrifice layer 36 is isotropically etched by the etchant such as TMAH entered through the etching hole 31.

When the sacrifice layer 36 has been isotropically etched, the etched space (removed portion) is infiltrated with the etchant, and one portion of a bent hole 26 is formed at the etched portion of the sacrifice layer 36. However, even when the removed portion of the sacrifice layer 36 is infiltrated with the etchant, since the surface of the Si substrate 22 is covered with the protective film 32, the surface of the Si substrate 22 is not etched.

Moreover, when the sacrifice layer 36 is further etched to allow the etchant to reach the sacrifice layer 35, and when the sacrifice layer 35 is isotropically etched by the etchant such as TMAH, an etching window 34 is opened in a space formed by the etched sacrifice layer 35, as shown in FIG. 6(*b*). Since an etching start position α in a space between the vibration film 24 and the protective film 32 is located at a position apart from the edge of the etching window 34, a bent hole 26 is formed in the space between the vibration film 24 and the protective film 32, and the length of the passage of the bent hole 26 can be elongated. In the present embodiment, the etching start position α is positioned at the edge of the vibration film 24, which is different from the etching start position of the sacrifice layer 36.

When the surface of the Si substrate 22 is exposed from the etching window 34, the etching window 34 is infiltrated with the etchant such as TMAH so that the Si substrate 22 is crystal anisotropically etched from the surface side toward the back face side, and the etching process of the sacrifice layer 35 and the Si substrate 22 further progresses also in a horizontal direction. As a result, as shown in FIG. 6(*c*), a cavity 23 is formed on the surface side of the Si substrate 22. In the cavity 23, the etching process is stopped at a position where its upper surface opening is made coincident with the etching window 34.

When the sacrifice layers 35 and 36 have been completely etched and the cavity 23 has reached a desired depth, the Si substrate 22 is raised from the etchant, thereby completing the etching process of the cavity 23.

Next, as shown in FIG. 6(*c*), acoustic holes 30 are formed on the fixed electrode 29 by etching, and acoustic holes 28 are also formed on the back plate 27 by etching.

Thereafter, the protective films 32, 37 and 38 that protect the vibration film 24 are etched and removed by using an HF aqueous solution or the like. At this time, the protective films 32 and 37 are left at four corners of the vibration film 24 to form supporting posts 25. Simultaneously, the protective film 33 on the back face side is also removed to complete a microphone 21 having a structure as shown in FIGS. 2(*a*) and 2(*b*).

In the microphone 21 of embodiment 1, since the cavity 23 is formed by crystal anisotropically etching the Si substrate 22 from the surface side, the cavity 23 is not expanded on the back face side so that it is possible to prevent the chip size of the microphone 21 from becoming larger by the cavity 23.

Moreover, in spite of the fact that the cavity 23 is etched from the surface side, it is not necessary to form etching holes on the vibration film 24, there is neither the possibility that the strength of the vibration film 24 is lowered, nor the possibility that the acoustic characteristics of the vibration film 24 are changed, due to the etching hole.

Moreover, since only one portion of the vibration film 24 (that is, four corner portions) is secured by the supporting posts 25, the vibration film 24 can be changed in its shape flexibly and tends to be elastically deformed, and the sensitivity of the microphone 21 can be improved.

Moreover, in this microphone 21, since the upper face side and the lower face side of the vibration film 24 are allowed to communicate with each other through the bent hole 26, it is possible to prevent the sensitivity of the microphone 21 from lowering due to warping of the vibration film caused by a static pressure difference between the upper face side and the lower face side of the vibration film 24.

Moreover, in this microphone 21, since the passage length of the bent hole 26 can be prolonged by lengthening the distance between the chemical charging port 31 and the edge of the etching window 34, the acoustic resistance of the bent hole 26 can be raised, thereby making it possible to improve the low-frequency characteristic of the microphone 21. This point is quantitatively explained as follows:

The resistance component Rv of the bent hole is represented by:

$$Rv=(8\mu ta^2)/(Sv^2) \quad \text{(Equation 1)}$$

Wherein, μ represents a frictional loss coefficient of the bent hole, t represents the passage length of the bent hole, a represents an area of the vibration film, and Sv represents an area of the bent hole. Moreover, the roll off frequency fL (limit frequency to cause a reduction in the sensitivity) of the microphone is represented by:

$$1/fL=2\pi Rv(Cbc+Csp) \quad \text{(Equation 2)}$$

Wherein, Rv represents a resistance component of the above equation, Cbc represents an acoustic compliance of the cavity, and Csp represents a stiffness constant of the vibration film.

In the microphone 21 of embodiment 1, by separating the position of the chemical charging port 31 from the edge of the etching window 34 as described above, the passage length t of the bent hole 26 between the upper face of the Si substrate 22 and the vibration film 24 can be made longer. Therefore, as can be understood from the above (Equation 1), by lengthening the passage length t of the bent hole 26, the acoustic resistance can be made very high, and as can be also understood from the above (Equation 2), the low-frequency characteristics of the semiconductor sensor elements 61 and 62 can be improved so that it is possible to provide preferable characteristics for the microphone.

As described in U.S. Pat. No. 5,452,268 and the like, the cross-sectional area of the bent hole opening portion is made smaller so as to enhance the acoustic resistance. However, there is a limitation in making the cross-sectional area of the bent hole smaller from the viewpoint of the process rule, and it is not possible to expect effects so much. In contrast, in the microphone 21 of embodiment 1, since the passage length of the bent hole 26 can be made longer, the acoustic vibration after passing through the bent hole 26 can be made very small so that the low-frequency characteristic of the microphone 21 can be improved as described above.

Figure 9:
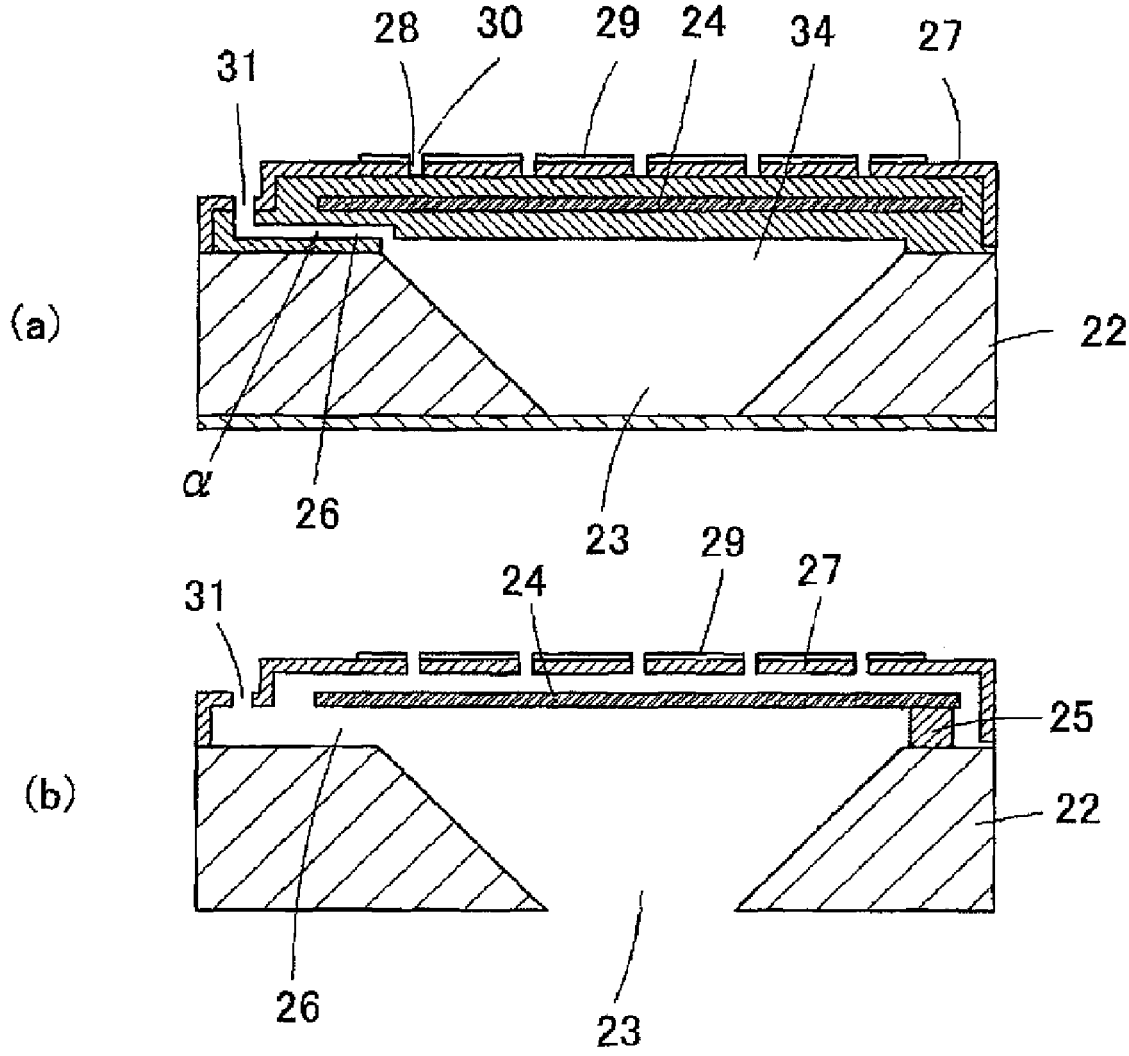
FIGS. 9(*a*) and 9(*b*) are cross-sectional views that show one portion of manufacturing processes of a microphone in accordance with a modified example of embodiment 1.

FIG. 9 is a cross-sectional view showing manufacturing processes of a modified example of embodiment 1. In this modified example, the cavity 23 is allowed to penetrate the Si substrate 22 from the surface side to back face side. In this manufacturing method, after having been subjected to the processes as shown in FIGS. 4(*a*) to 4(*d*), FIGS. 5(*a*) to 5(*d*) and FIGS. 6(*a*) and 6(*b*), a crystal anisotropic etching process is carried out from the surface side of the Si substrate 22 through the etching window 34, as shown in FIG. 9(*a*). The etching window 34 is opened widely in comparison with that of embodiment 1, and upon forming the cavity 23 through the crystal anisotropic etching process, the Si substrate 22 is immersed in an etchant such as TMAH for a long period of time. As a result, the cavity 23 is soon allowed to reach the back face of the Si substrate 22 to penetrate the Si substrate 22 from the surface side to back face side. Thereafter, as shown in FIG. 9(*b*), the protective films 32, 37 and 38 that protect the vibration film 24 are etched and removed by an HF aqueous solution or the like, with the supporting posts 25 being left.

In accordance with this modified example, since the capacity of the cavity 23 can be made larger, the acoustic characteristic of the microphone is improved. That is, the acoustic compliance Ccav (acoustic compliance of the back chamber) of the cavity 23 is represented by:

$$Ccav = Vbc/(\rho c^2 Sbc) \quad \text{(Equation 3).}$$

Wherein, Vbc represents the volume (back chamber volume) of the cavity 23, $\rho c^2$ represents the volume elastic modulus of air, and Sbc represents the area of the opening portion of the cavity 23.

In the modified example, by allowing the cavity 23 to penetrate the Si substrate 22 through both of the surface and back face, it is possible to form a cavity 23 having a volume that is greater in comparison with the opening area, and as can be understood from the above (Equation 3), the acoustic compliance of the through hole 14 can be made larger so that, even when the bent hole 63 is opened, the sensitivity is hardly made less.

Moreover, in the modified example, since the cavity 23 is allowed to penetrate through both of the surface and back face, the acoustic vibration can be sensed even from the back face side.

Embodiment 2

Figure 10:
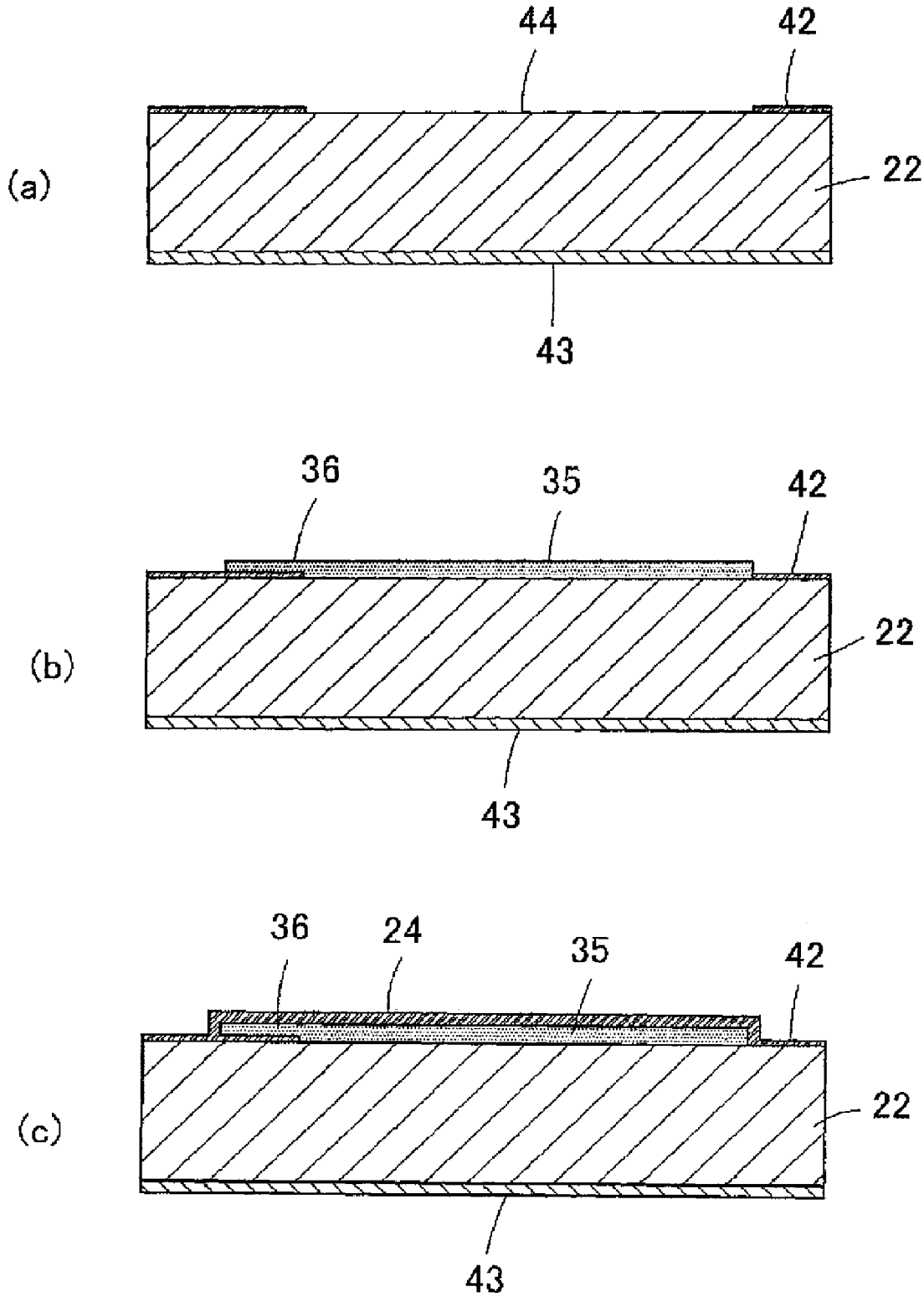
FIGS. 10(*a*) to 10(*c*) are cross-sectional views showing manufacturing processes of a microphone of embodiment 2.
Figure 11:
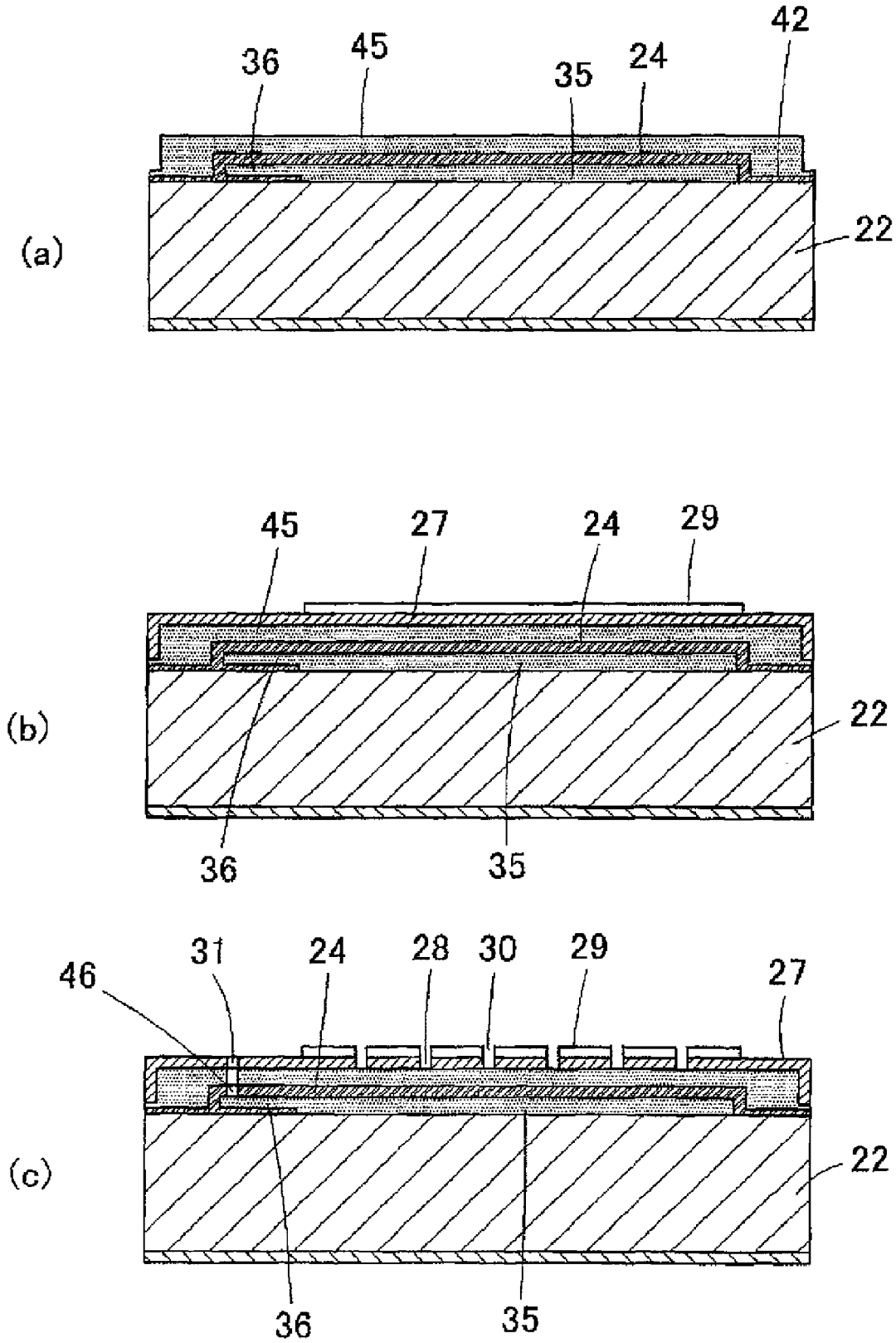
FIGS. 11(*a*) to 11(*c*) are cross-sectional views showing manufacturing processes of the microphone of embodiment 2, which follow FIG. 10(*c*).
Figure 12:
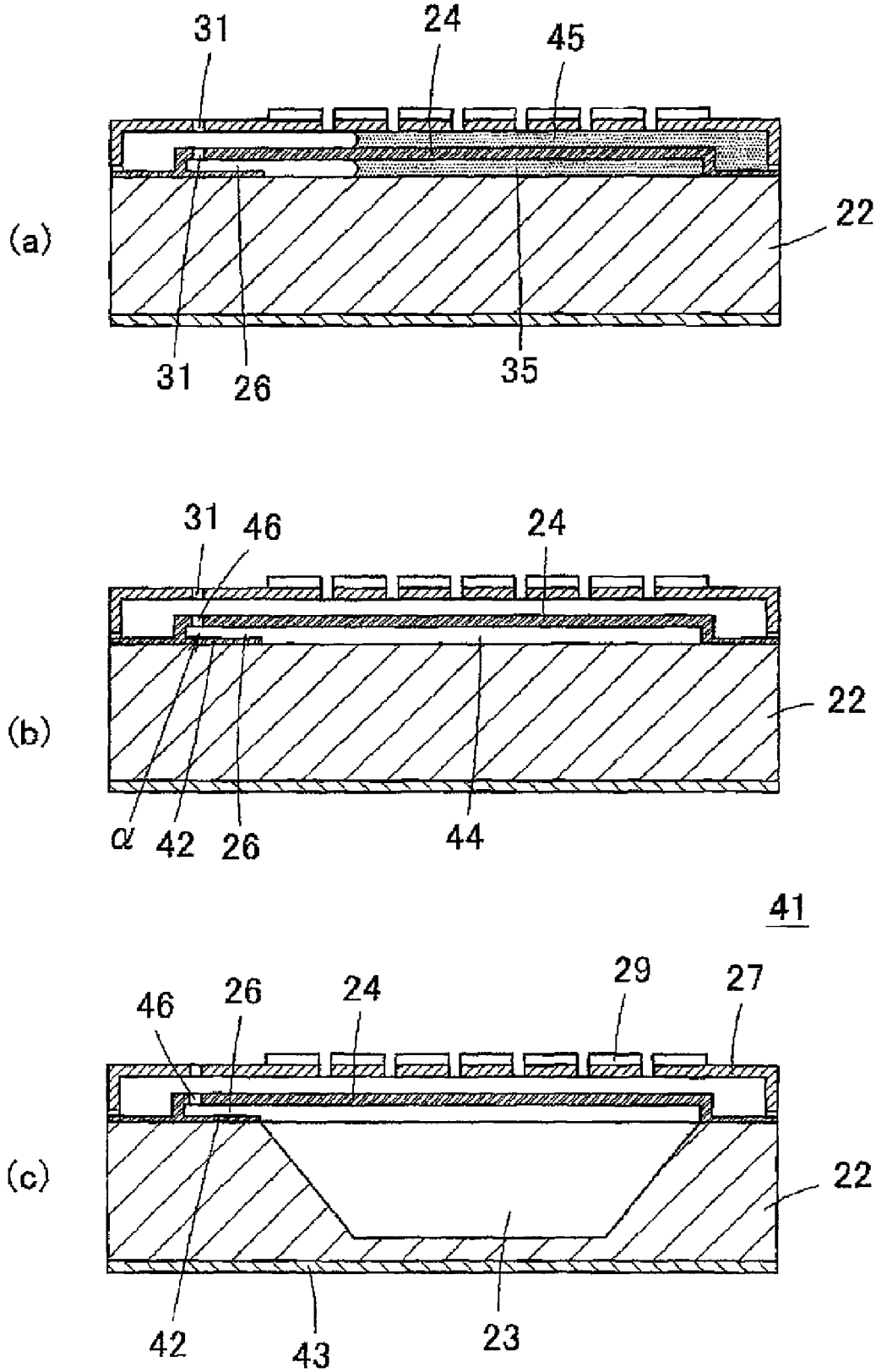
FIGS. 12(*a*) to 12(*c*) are cross-sectional views showing manufacturing processes of the microphone of embodiment 2, which follow FIG. 11(*c*).

FIGS. 10(*a*) to 10(*c*), FIGS. 11(*a*) to 11(*c*) and FIGS. 12(*a*) to 12(*c*) are cross-sectional views that show manufacturing processes of a microphone 41 in accordance with embodiment 2 of the present invention. A microphone 41, obtained through these manufacturing processes, makes it possible to eliminate the necessity of a protective film for protecting the vibration film 24 from an etchant upon etching the sacrifice layers 35 and 36 as well as the Si substrate 22; therefore, the film-forming process for the microphone 41 can be simplified. The following description will discuss the manufacturing process thereof.

First, as shown in FIG. 10(*a*), a vibration film supporting layer 42 (etching protective film) and a protective film 43, made from SiN, are formed on the surface and the back face of a (100) plane or a (110) plane of an Si substrate 22 (wafer). Next, on the surface of the Si substrate 22, the vibration film supporting layer 42 on an area where a cavity 23 is to be formed is partially removed by using a photolithographic technique so that an etching window 44 is opened in accordance with the upper face opening of the cavity 23 to be formed.

An $SiO_2$ thin-film is formed on the surface of the Si substrate 22 over the vibration film supporting layer 42, and the $SiO_2$ thin-film is patterned by using a photolithographic technique. Thus, a sacrifice layer 35, made of an $SiO_2$ thin-film, is formed on the surface of the Si substrate 22 inside the etching window 44. Moreover, on the upper face of the vibration film supporting layer 42, a sacrifice layer 36, made of an $SiO_2$ thin-film, is formed in such a manner to connect to the sacrifice layer 35 on an area where a bent hole 26 is to be formed. FIG. 10(*b*) shows this state.

Next, as shown in FIG. 10(*c*), a vibration film 24, made from SiN, is formed on the surface of the Si substrate 22 over the sacrifice layers 35 and 36 so that the sacrifice layers 35 and 36 are covered with the vibration film 24. After the vibration film 24 has been formed by etching, an $SiO_2$ thin-film is formed on the vibration film 24, as shown in FIG. 11(*a*), and a protective film 45 is formed so that the vibration film 24 and the vibration film supporting layer 42 are covered with the protective film 45.

After the protective film 45 has been etched in accordance with the inner face shape of the back plate 27 as shown in FIG. 11(*b*), an SiN film is formed on the surface of the protective film 45 to form a back plate 27. Moreover, a fixed electrode 29 made from Au/Cr is formed on the back plate 27.

As shown in FIG. 11(*c*), acoustic holes 30 are opened on the fixed electrode 29 by etching, and a chemical charging port 31 and acoustic holes 28 are then opened on the back plate 27. Moreover, from the chemical charging port 31, the protective film 45 and the end of the vibration film 24, located right below, are partially opened so that an etching hole 46 is opened on the vibration film 24 right below the chemical charging port 31, and the sacrifice layer 36 is exposed from the etching hole 46.

Thereafter, when the Si substrate 22 is immersed in an HF aqueous solution, the HF aqueous solution etches $SiO_2$ isotropically so that, as shown in FIG. 12(*a*), the protective film 45 is isotropically etched by the HF aqueous solution entered through the chemical charging port 31, and the sacrifice layer 36 is further isotropically etched by the HF aqueous solution entered through the etching hole 46.

When the sacrifice layer 36 is isotropically etched, one portion of the bend hole 26 is formed at a portion corresponding to the isotropically-etched sacrifice layer 36. Moreover, when the sacrifice layer 36 is further etched so that the HF aqueous solution reaches the sacrifice layer 35, the sacrifice layer 35 is isotropically etched by the HF aqueous solution, and an etching window 34 is opened at a space corresponding to the etched sacrifice layer 35.

As shown in FIG. 12(*b*), after the sacrifice layers 36 and 35 have been completely etched and removed and the protective film 45 has been etched, with the lower face portion of the back plate 27 being left, the Si substrate 22 is raised from the HF aqueous solution. Since an etching start position $\alpha$ in a space between the vibration film 24 and the vibration film supporting layer 42 is located at a position apart from the edge of the etching window 34, a bent hole 26 is generated in the space between the vibration film 24 and the protective film 32, and the length of the passage of the bent hole 26 can be made longer In the present embodiment, the etching start position $\alpha$ is located at the position of the etching hole 46, and coincident with the etching start position of the sacrifice layer 36.

Next, the Si substrate 22 is immersed into an etchant such as TMAH or the like. This etchant enters the etching window 44 through the etching hole 46 so that the Si substrate 22 is crystal isotropically etched from the surface side. As a result, as shown in FIG. 12(*c*), as in embodiment 1, a cavity 23 is formed on the upper face side of the Si substrate 22. Thus, the Si substrate 22, with a desired cavity 23 being formed therein, is raised from the etchant such as TMAH or the like, and this is further washed and dried, thereby completing a microphone 41.

By manufacturing the microphone 41 in this manner, a cavity 23 having a small expansion on the back face side can be opened by using only the etching process from the surface side of the Si substrate 22, and the microphone 41 can be consequently minimized. Moreover, although an etching hole 46 is opened on the vibration film 24, this serves as an opening end of the bent hole 26, and since this is formed at a position apart from the vibration portion of the vibration film 24, it is possible to reduce the possibility of changing the physical properties of the vibration film 24 in the microphone 41 and the possibility of reducing the strength of the vibration film 24.

Moreover, in the case of embodiment 2, since the vibration film 24 is formed by a material (SiN) having durability to etchant, such as TMAH, used for etching the Si substrate 22, no protective film for protecting the lower face of the vibration film 24 is required, unlike to embodiment 1; thus, in a manufacturing process of the microphone 41, the film-forming operation can be simplified, making it possible to lower the manufacturing costs of the microphone 41.

Moreover, in the case of embodiment 1, since the crystal anisotropic etching and isotropic etching are carried out by using the same etchant, the crystal anisotropic etching and isotropic etching can be continuously carried out in the same device so that a high operation efficiency can be obtained. In contrast, in the case of embodiment 2, the crystal anisotropic etching and isotropic etching are carried out in different processes, it becomes possible to reduce limitations to the crystal anisotropic etching means and isotropic etching means so that, for example, the isotropic etching process may be a chemical etching using a corrosive gas or the like.

Embodiment 3

Figure 13:
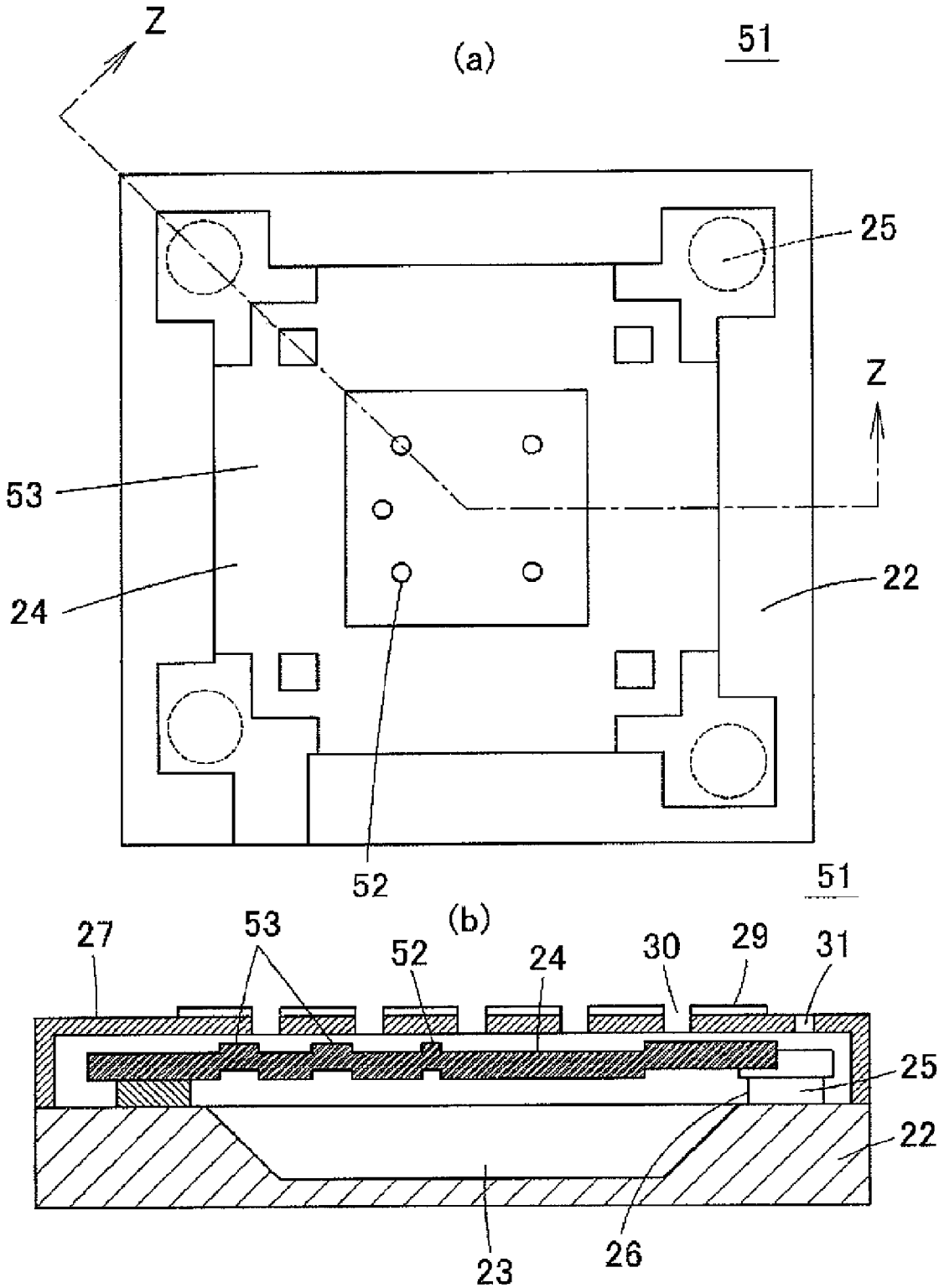
FIG. 13(*a*) is a plan view showing a structure of a microphone (from which a back plate has been removed) in accordance with embodiment 3 of the present invention, and FIG. 13(*b*) is a Z-Z line cross sectional view of FIG. 13(*a*).

FIG. 13(*a*) is a plan view that shows a structure of a microphone 51 in accordance with embodiment 3 of the present invention, and FIG. 13(*b*) is a Z-Z line cross-sectional view of FIG. 13(*a*). This microphone 51 is characterized by adding a functional unit, such as a wrinkle (crease) structure and a stopper 52, to the vibration film 24.

The wrinkle structure of the vibration film 24 is formed by a bent portion 53 having a square ring shape. The bent portion 53 is bent so as to protrude toward the upper face side of the vibration film 24 in its cross section. By forming this wrinkle structure in the vibration film 24 in this manner, the positional change of the vibration film 24 is increased and the deflection due to a stress is reduced, and these facts are reported by "The fabrication and use of micromachined corrugated silicon diaphragms" (J. H. Jerman, Sensors and Actuators A21-A23 pp. 998-992, 1992).

The stopper 52 is formed by allowing the surface of the vibration film 24 to protrude in a round protruded shape. In the case of a microphone 51 of an electrostatic capacity type, the vibration film 24 serves as a movable electrode, and a fixed electrode 29 is disposed above the vibration film 24. In the microphone 51 of the electrostatic capacity type, by placing the stopper 52 on the upper face of the vibration film 24, even when the vibration film 24 is deformed to a great degree, the stopper 52 is made in contact with the fixed electrode so that it is possible to prevent the vibration film 24 from being stuck to the fixed electrode 29 by an electrostatic force and failing to return.

Figure 14:
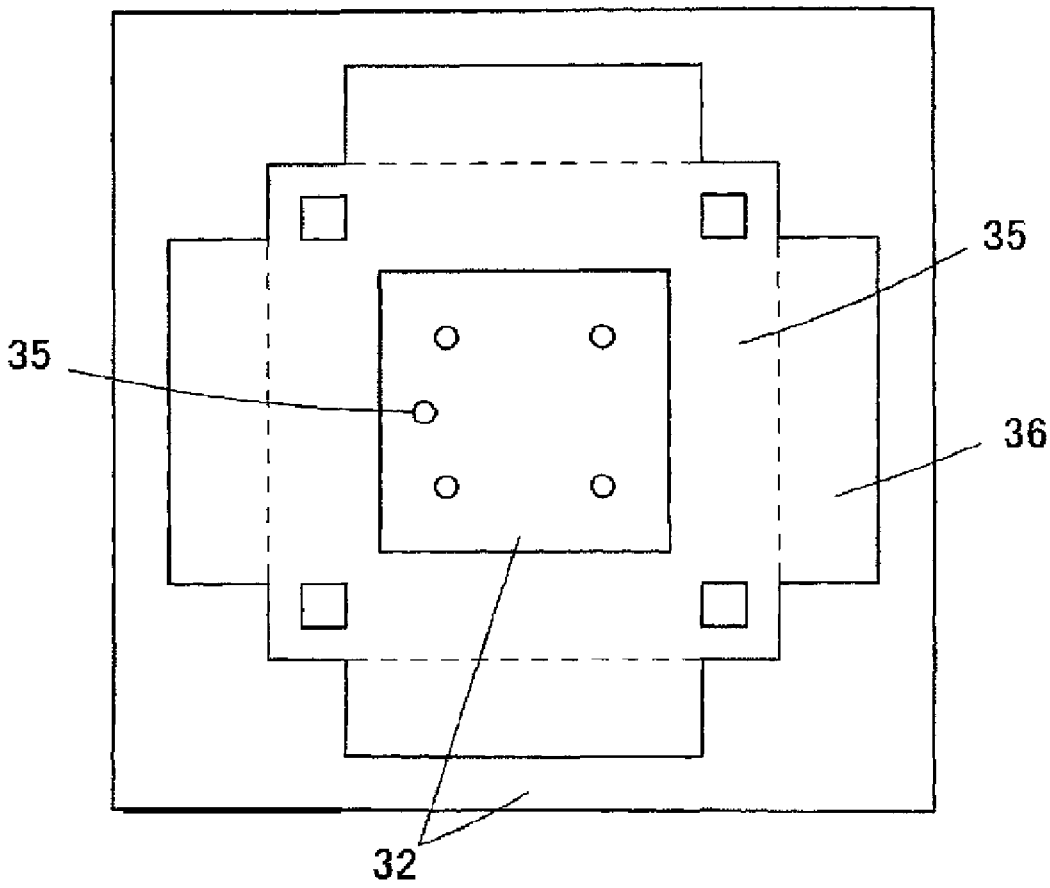
FIG. 14(*a*) is a plan view showing a shape of a sacrifice layer formed on an Si substrate, and FIG. 14(*b*) is a cross-sectional view of FIG. 14(*a*).
Figure 14:
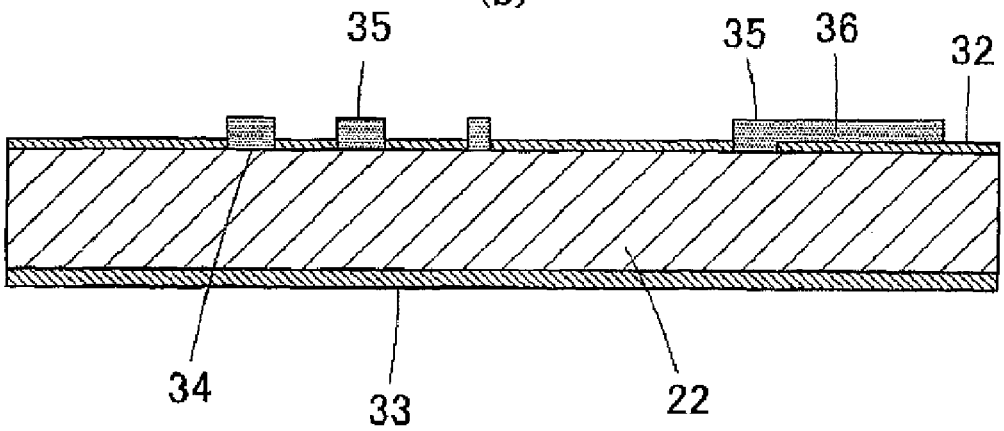
Figure 15:
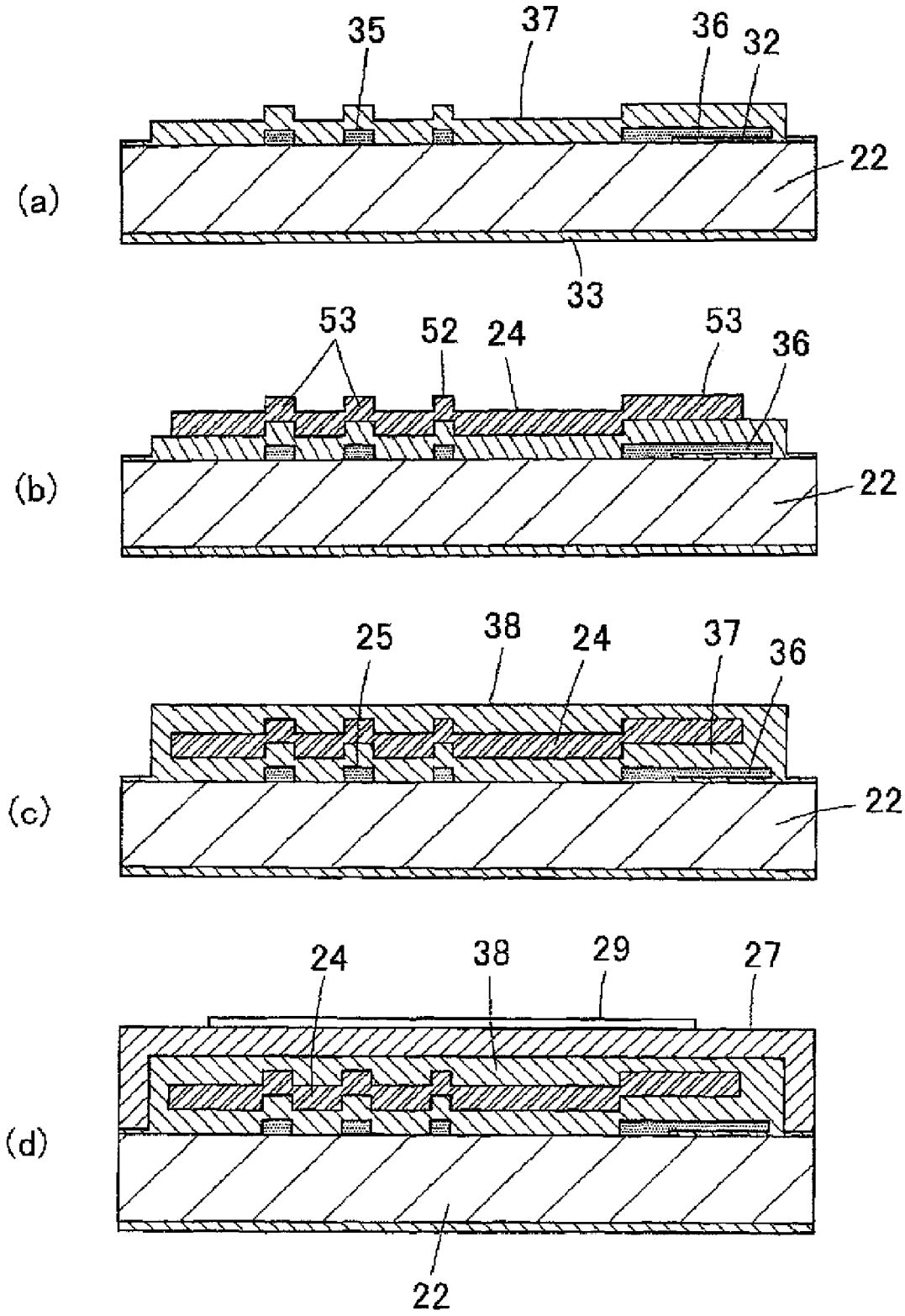
FIGS. 15(*a*) to 15(*d*) are cross-sectional views showing manufacturing processes of a microphone of embodiment 3, which follow FIG. 14.
Figure 16:
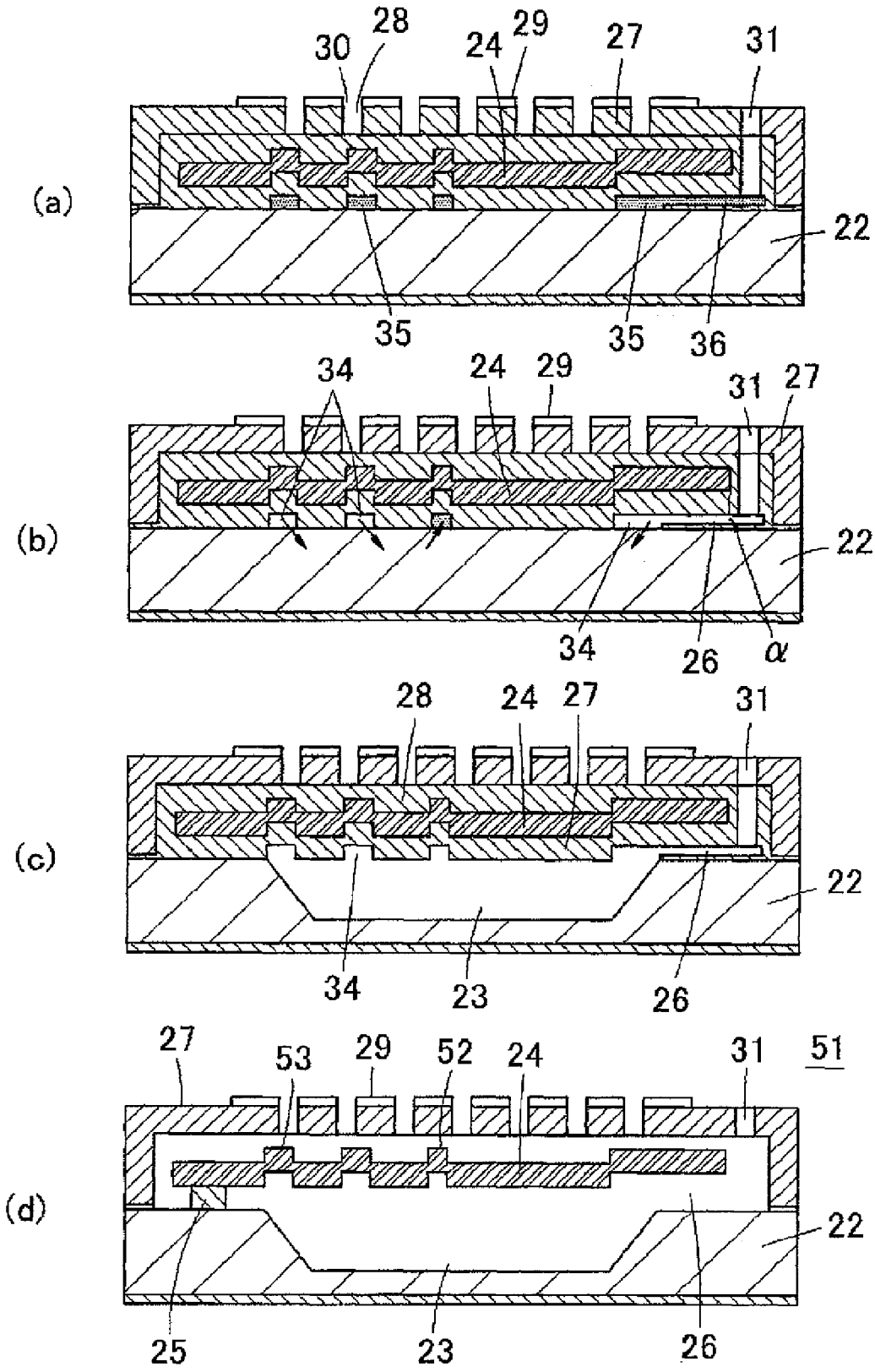
FIGS. 16(*a*) to 16(*d*) are cross-sectional views showing manufacturing processes of the microphone of embodiment 3, which follow FIG. 15(*d*).
Figure 17:
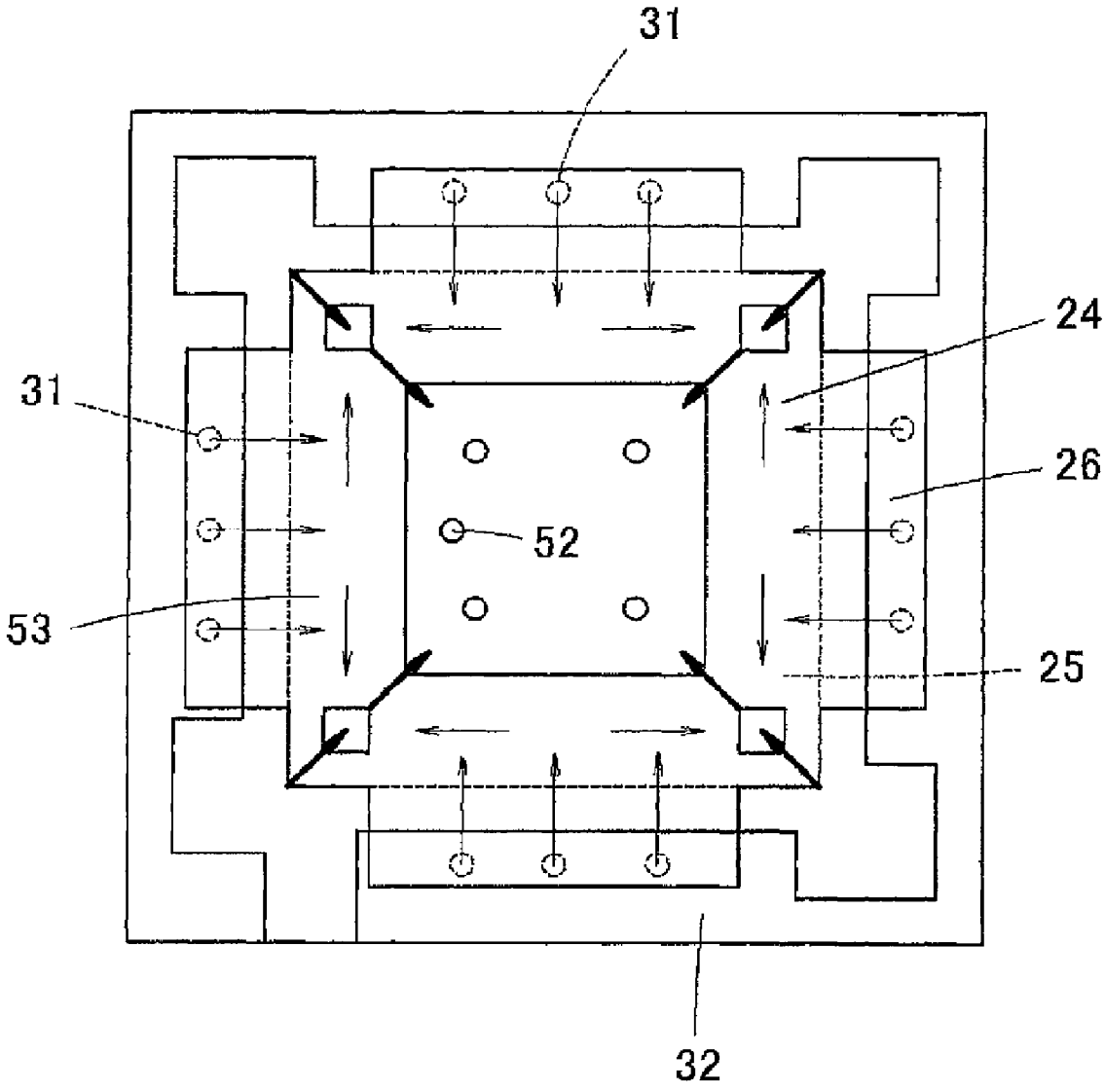
FIG. 17 is a schematic drawing that shows a state in which the sacrifice layer is subjected to an isotropic etching process, and a state in which an Si substrate is subjected to a crystal anisotropic etching process.

FIGS. 14(*a*), 14(*b*), FIGS. 15(*a*) to 15(*d*), FIGS. 16(*a*) to 16(*d*) and FIG. 17 are drawings that explain manufacturing processes of the microphone 51. Referring to FIGS. 14 to 17, the following description will discuss the manufacturing processes of the microphone 51. First, as shown in FIGS. 14(*a*) and 14(*b*), a protective film 32 (etching protective film) and a protective film 33 are formed on the surface and back face of the Si substrate 22 by using $SiO_2$ thin films. Next, within an area to form an upper face opening of the cavity 23, the protective film 32 is etched at portions where the bent portion 53 and the stopper 52 are to be formed so that an etching window 34 is opened.

Next, a polysilicon thin-film is formed on the entire surface of the Si substrate 22 over the protective film 32, and this polysilicon thin film is etched into a predetermined pattern so that a sacrifice layer 35 is formed by the polysilicon thin film remaining inside the etching window 34 of the protective film 32 and a sacrifice layer 36 is also formed on an area where a bent hole 26 is to be formed on the upper face of the protective film 32.

Next, as shown in FIG. 15(*a*), the surface of the Si substrate 22 is covered with a protective layer 37 made from $SiO_2$ over the sacrifice layers 35 and 36. At this time, since the protective film 37 is formed on the respective sacrifice layers 35 and 36, the protective layer 37 is allowed to protrude upward at portions of the respective sacrifice layers 35 and 36.

As shown in FIG. 15(*b*)B, a vibration film 24 made of a polysilicon thin film is formed on the protective film 37. Within the areas of the respective sacrifice layers 35 and 36, since the vibration film 24 is lifted by the respective sacrifice layers 35 and 36 through the protective film 37 so that the bent portion 53 and the stopper 52 are formed on the sacrifice layers 35 and 36.

Moreover, as shown in FIG. 15(*c*), a protective film 38 made from $SiO_2$ is formed on the vibration film 24 to cover and conceal the vibration film 24. After the protective films 37 and 38 have been etched in accordance with the inner face shape of a back plate 27, an SiN film is formed on the surface of the protective film 45, as shown in FIG. 15(*d*) and the back plate 27 is formed. Moreover, a fixed electrode 29 made from Au/Cr is formed on the back plate 27.

As shown in FIG. 16(*a*), acoustic holes 30 are formed on the fixed electrode 29 by etching, and a chemical charging port 31 and acoustic holes 28 are then opened on the back plate 27. Moreover, from the chemical charging port 31, the protective films 38 and 37, located right below, are partially opened so that the sacrifice layer 36 is exposed below the chemical charging port 31.

Thereafter, when the Si substrate 22 is immersed in an etchant such as TMAH, the etchant such as TMAH isotropically etches polysilicon so that, as shown in FIG. 16(*b*), the sacrifice layer 36 is isotropically etched by the etchant entered from the chemical charging port 31.

When the sacrifice layer 36 is isotropically etched, the etched space is infiltrated with the etchant, and one portion of a bent hole 26 is formed at the etched portion of the sacrifice layer 36. Moreover, when the sacrifice layer 36 is etched and the etchant reaches the sacrifice layer 35, the sacrifice layer 35 is isotropically etched by the HF aqueous solution, as indicated by a thin-line arrow in FIG. 17, and an etching window 34 is opened at a space corresponding to the etched sacrifice layer 35.

When the etching window 34 has been opened, a crystal anisotropic etching process further progresses onto the Si substrate 22 from the edge portion of the etching window 34, as indicated by a bold-line arrow of FIG. 17, and a cavity 23 is formed on the surface side of the Si substrate 22, as shown in FIG. 16(*c*).

As a result, on the surface side of the Si substrate 22, the etched cavity 23 is formed in an area on the inner side from the etching window 34. Thus, at the time where the cavity 23 has been completely formed, the Si substrate 22 is raised from the etchant such as TMAH.

After washing the Si substrate 22, the protective films 32, 37 and 38 made from $SiO_2$ are etched and removed with an HF aqueous solution, as shown in FIG. 16(*d*), at the time where only the supporting posts 25 derived from the protective film 37 have been left, the etching process is finished, and this is washed and dried to complete a microphone 51.

In embodiments 1 to 3, the sacrifice layers and the like, made of Si substrates and polysilicon, are etched by an etchant such as TMAH; however, materials other than TMAH, such as KOH and EDP, may be used as the etchant. Moreover, substrates other than Si substrates, such as compound semiconductor substrates, may be used as the semiconductor substrate.

The invention claimed is:

1. A microphone manufacturing method comprising the steps of:

forming an etching protective film on a surface of a semiconductor substrate, and then opening an etching window through said etching protective film;

forming a sacrifice layer in said etching window and on an upper face of said etching protective film;

forming a vibration film above said sacrifice layer;

starting an etching process of said sacrifice layer through a preformed port at a location wherein said sacrifice layer is sandwiched by said vibration film and said etching protective film and wherein said port is located at a position apart from said etching window, by using an etchant to which said etching protective film is resistant, so that said etching window is opened; and crystal anisotropically etching said semiconductor substrate through said port and said etching window by using an etchant to which said etching protective film is resistant so that a cavity is formed on the surface side of said semiconductor substrate.

2. The microphone manufacturing method according to claim 1, further comprising the step of:

prior to forming said vibration film and after forming said sacrifice layer, forming a protective film on said sacrifice layer, by using a material that is resistant to said etchant used for etching said sacrifice layer as well as an etchant used for etching said semiconductor substrate.

3. The microphone manufacturing method according to claim 1, further comprising the step of forming a protective film on said vibration film using a material that is resistant to said etchant used for etching said sacrifice layer as well as an etchant used for etching said semiconductor substrate.

4. The microphone manufacturing method according to claim 3, wherein, by etching the protective film on one portion of a formation area of said vibration film, said vibration film is allowed to bend.

5. The microphone manufacturing method according to claim 1, wherein said semiconductor substrate is crystal anisotropically etched by using an etchant that is different from said etchant used for etching said sacrifice layer.

6. The microphone manufacturing method according to claim 1, further comprising the step of:

forming a back plate having a fixed electrode above said vibration film.

7. The microphone manufacturing method according to claim 1, wherein said cavity is etched such as to penetrate said semiconductor substrate from the surface side to back face side.

8. The microphone manufacturing method according to claim 1, wherein said sacrifice layer is isotropically etched and said semiconductor substrate is crystal anisotropically etched by using the same etchant.

9. The microphone manufacturing method according to claim 1, wherein, by forming said sacrifice layer on at least one portion of a formation area of said vibration film, at least one stopper is formed on the surface of said vibration film.

* * * * *